US008800888B2

(12) United States Patent
Yang et al.

(10) Patent No.: US 8,800,888 B2
(45) Date of Patent: Aug. 12, 2014

(54) DRIVING DEVICE FOR LIFTING BURIED SPRAYING HEAD

(75) Inventors: Jiyue Yang, Guangdong (CN); Hongbin Huang, Guangdong (CN)

(73) Assignee: Guangdong Liansu Technology Industrial Co., Ltd., Foshan (CN)

( * ) Notice: Subject to any disclaimer, the term of this patent is extended or adjusted under 35 U.S.C. 154(b) by 420 days.

(21) Appl. No.: 13/320,332

(22) PCT Filed: Jan. 15, 2010

(86) PCT No.: PCT/CN2010/070207

§ 371 (c)(1),
(2), (4) Date: Nov. 14, 2011

(87) PCT Pub. No.: WO2011/079534

PCT Pub. Date: Jul. 7, 2011

(65) Prior Publication Data

US 2012/0056012 A1 Mar. 8, 2012

(30) Foreign Application Priority Data

Dec. 31, 2009 (CN) ..... 2009 1 0214546

(51) Int. Cl.
*B05B 15/10* (2006.01)

(52) U.S. Cl.
USPC ..... 239/206; 239/225.1

(58) Field of Classification Search
CPC ..... B05B 15/10; B05B 3/10
USPC ..... 239/206, 203, 204, 225.1, 263, 237, 239/223
See application file for complete search history.

(56) References Cited

U.S. PATENT DOCUMENTS

| | | | | |
|---|---|---|---|---|
| 3,713,584 | A * | 1/1973 | Hunter | 239/206 |
| 5,711,486 | A * | 1/1998 | Clark et al. | 239/205 |
| 7,631,813 | B1 * | 12/2009 | Lichte et al. | 239/11 |
| 2007/0246568 | A1 | 10/2007 | Baird | |

FOREIGN PATENT DOCUMENTS

| | | | |
|---|---|---|---|
| CN | 2277822 | Y | 4/1998 |
| CN | 2541060 | Y | 3/2003 |
| CN | 101336137 | A | 12/2008 |
| EP | 0177128 | A2 | 4/1986 |
| WO | 2009036382 | A1 | 3/2009 |

OTHER PUBLICATIONS

International Search Report for PCT/CN2010/070207, dated Oct. 21, 2010.

* cited by examiner

*Primary Examiner* — Davis Hwu
(74) *Attorney, Agent, or Firm* — Pearne & Gordon LLP

(57) ABSTRACT

A driving device for a lifting buried spraying head includes a case (2), a filter (3) provided in the lower end of the case (2), and a spraying head driving unit disposed inside the case (2). The spraying head driving unit connects with a spraying head located on the top end of the case via a main shaft, and the spraying head driving unit drives the spraying head to rotate and spray water. Wherein, the spraying head driving unit comprises a tangential flow generator (4) and a hydraulic rotator (5). The tangential flow generator (4) is a small case structure which is hollow, and a water supply gap is formed between the tangential flow generator and the inner wall of the case (2). Inflow openings (44) are arranged on the shell wall of the tangential flow generator (4). The hydraulic rotator (5) is disposed inside the tangential flow generator (4), and the hydraulic rotator (5) has stress surfaces (55) corresponding to the inflow openings (44). The hydraulic rotator (5) connects with the spraying head directly or indirectly via the main shaft.

10 Claims, 4 Drawing Sheets

DRIVING DEVICE FOR LIFTING BURIED SPRAYING HEAD

The present application is the national phase of International Application No. PCT/CN2010/070207, titled "DRIVING DEVICE FOR LIFTING BURIED SPRAYING HEAD", filed on Jan. 15, 2010, which claims the benefit of priority to Chinese patent application No. 200910214546.6 titled "DRIVING DEVICE FOR LIFTING BURIED SPRAYING HEAD", filed on Dec. 31, 2009. The entire disclosure thereof is incorporated herein by reference.

FIELD OF THE INVENTION

The invention relates to the field of water-saving irrigation fitting structures, in particular to a hydraulic driving device for a hydraulic lifting buried spaying head.

BACKGROUND OF THE INVENTION

Currently, injection pipe technology is adopted to meet water use requirements of places with high water consumption, such as urban green spaces, golf courses, etc. The traditional injection pipe product is complex in structure, having the structure that filtered water rushes at a multi-piece airfoil impeller positioned on an end surface at a certain angle to drive a main shaft to rotate, and a driving gear provided on the main shaft drives a nozzle to rotate after multi-grade gear pair deceleration, achieving the object of spraying. In this driving structure, excess gear pairs brings high difficulty for manufacture and assembly; especially high rotating speed of the driving gear requires high mounting accuracy of each gear shaft and high manufacturing accuracy of each gear shaft hole; and particularly, because module of each gear is small, which is merely 0.5 basically, there are high demands on the manufacturing accuracy and the assembly accuracy of the gears. Therefore, such driving structure has high manufacture cost. Because gears are in hard connections from the first gear to the nozzle, when water pressure changes, the rotational angular velocity of the spraying head fluctuates directly along with the fluctuation of water pressure and varies obviously; and frequently variation of water pressure will damage gear pairs at all levels.

SUMMARY OF THE INVENTION

The object of the invention is to provide a hydraulic driving device for a lifting buried spraying head with simple structure and convenient assembly and overcome the defects of the prior art.

The invention employs the following technical scheme to realize the above object:

A driving device for lifting buried spraying head includes a case, a filter provided in the lower end of the case, and a spraying head driving unit disposed inside the case. The spraying head driving unit is connected with a spraying head located on the top end of the case via a main shaft, and the spraying head driving unit drives the spraying head to rotate and spray water. The spraying head driving unit comprises a tangential flow generator and a hydraulic rotator. The tangential flow generator is a small case structure which is hollow, and a water supply gap is formed between the tangential flow generator and the inner wall of the case. Inflow openings are arranged on the shell wall of the tangential flow generator, the hydraulic rotator is disposed inside the tangential flow generator, the hydraulic rotator has stress surfaces corresponding to the inflow openings, and the hydraulic rotator is connected with the spraying head directly or indirectly via the main shaft.

The spraying head driving unit of the invention works based on interaction of the tangential flow generator and the hydraulic rotator, water filtered by the filter flows into the tangential flow generator from the inflow openings and lashes the hydraulic rotator to rotate the hydraulic rotator which drives the spraying head to rotate and spray water.

In the above technical scheme, the shell wall of the tangential flow generator is provided with a plurality of inflow openings which are evenly distributed, the hydraulic rotator is of a cyclic structure or disc structure, the outer edge of the hydraulic rotator is provided with a plurality of evenly distributed stress surfaces corresponding to the inflow openings, a gap exits between each stress surface and the corresponding inflow opening, water flows in the tangential flow generator from the inflow openings and lashes the stress surfaces of the hydraulic rotator to rotate the hydraulic rotator.

The tangential flow generator comprises a conical section and a cylindrical section, wherein the lower part of the conical section is provided with an annular hole, and the wall of the cylindrical section is provided with evenly distributed inflow openings.

Furthermore, the tangential flow generator comprises a sealing ring mounting groove positioned on the upper end of the cylindrical section, and a sealing ring for realizing sealing between the tangential flow generator and the inner wall of the case is mounted in the sealing ring mounting groove.

Said hydraulic rotator comprises a cylindrical ring body, a central shaft hole positioned on the center of the cylindrical ring body, shaft hole support ribs connected with the central shaft hole and the inner wall of the cylindrical ring body, and torsion teeth evenly distributed on the outer wall of the cylindrical ring body; and said torsion teeth have stress surfaces.

Furthermore, damping plates are evenly distributed on the inner wall of the cylindrical ring body.

The spraying head driving unit of the invention further comprises a hydraulic driving disc and a nozzle driving disc. The hydraulic driving disc is positioned above the hydraulic rotator and coaxially connected with the hydraulic rotator; said nozzle driving disc is mounted above the hydraulic driving disc, a gap is formed between the nozzle driving disc and the hydraulic driving disc in axial direction, and the nozzle driving disc is connected with the spraying head via a main shaft. With such structure, the spraying head driving unit adopts two-stage drive, in which the hydraulic rotator firstly drives the hydraulic driving disc to rotate, then the rotation of the hydraulic driving disc causes water between the hydraulic driving disc and the nozzle driving disc to rotate, and thus the water drives the nozzle driving disc to rotate to realize rotary spraying of the spraying head.

Furthermore, the hydraulic driving disc is provided with inflow holes and first swirling flow ribs, water below the hydraulic driving disc enters the gap between the hydraulic driving disc and the nozzle driving disc from the inflow holes and rotates under the action of blocking of the first swirling flow ribs.

The surface of the nozzle driving disc opposite to the hydraulic driving disc is provided with second swirling flow ribs, and the nozzle driving disc rotates under the action of water current impacting the second swirling flow ribs and thus to drive the spraying head to rotate and spray water.

In the invention, the main shaft used for connecting the hydraulic driving disc and the hydraulic rotator is mounted on a bracket, the main shaft used for connecting the nozzle driving disc and the spraying head is mounted on the bracket as well, and the bracket is fixed on the inner wall of the case.

The invention provides a novel spraying head driving structure in which a spraying head rotates under the action of tangential viscous force generated by water viscosity, especially the tangential viscous force generated by water viscosity is utilized twice, water current flowing on the tangential flow generator in the tangential direction firstly drives the outer cylindrical surface of the hollow cylinder of the hydraulic rotator to rotate, through a main shaft the driving cylinder which acts as a driving cylinder drives the hydraulic driving disc to rotate, and acting as a driving disc the hydraulic driving disc rotates to causes water current near the disc to rotate due to water viscosity, and thus to drive a nozzle driving disc which is connected with a spraying head and concentric with the driving disc and acts as a driven disc to rotate. Such driving structure has two significant advantages: firstly, the driving structure has no gear pairs and airfoil impeller, only has a liquid friction cylinder pair, a liquid friction disc pair and at most two shafts (one shaft connects the driving cylinder and the driving disc, and the other shaft connects the driven disc and the spraying head, while traditional product has more gear shaft because of more gear pairs), and therefore, the manufacture and assembly are greatly simplified; and secondly, because there are one grade of soft connection driven by water tangential force from the driving cylinder to the spraying head, when water pressure changes, the variation of rotary speed of the driven shaft will retarded, so that the rotary speed variation of the spraying head is reduced.

DETAILED DESCRIPTION OF THE PREFERRED EMBODIMENT

The invention is further described by combining the drawings.

Figure 1:
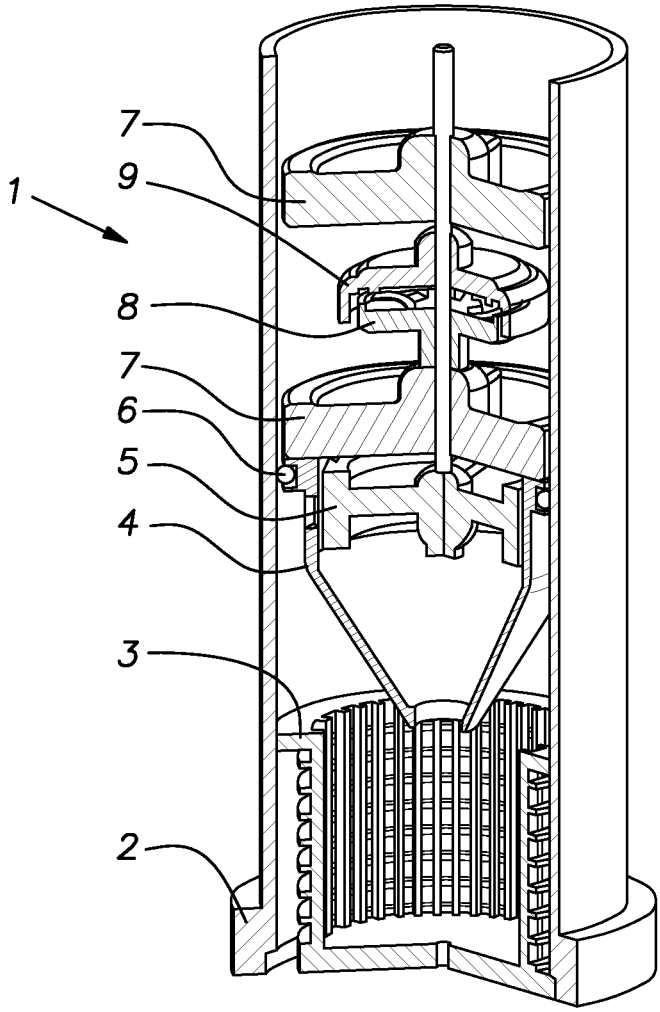
FIG. 1 is a structural diagram of the invention.

The invention has the structure that:

Referring to FIG. 1, the driving device comprises a case 2, a filter 3, a tangential flow generator 4, a hydraulic rotator 5, a sealing ring 6, a bracket 7, a hydraulic driving disc 8 and a nozzle driving disc 9. The specific installation structure is as follows: the filter 3 is mounted at the inlet of the case 2, the tangential flow generator 4 is positioned downstream of the filter 3, the hydraulic rotator 5 is mounted inside the tangential flow generator 4, the sealing ring 6 is mounted on the tangential flow generator 4 and forms a sealing surface with the inner wall of the case 2, the hydraulic driving disc 8 is fixedly connected with the hydraulic rotator 5 by a shaft and positioned downstream of the hydraulic rotator 5, the shaft is fixed on the inner wall of the case 2 via a bracket 7, the nozzle driving disc 9 is mounted downstream of the hydraulic driving disc 8 and has a gap to the hydraulic driving disc 8 in the axial direction, and the nozzle driving disc 9 is connected with a spraying head via a shaft fixed on the inner wall of the case 2 via the bracket 7.

Figure 2A:
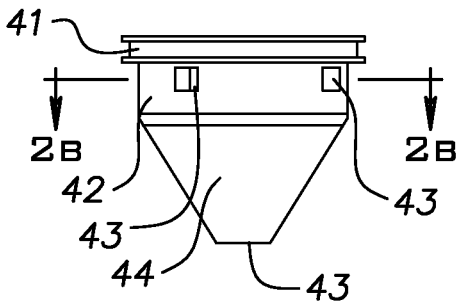
FIGS. 2A to 2D are structural diagrams of the tangential force generator.
Figure 2B:
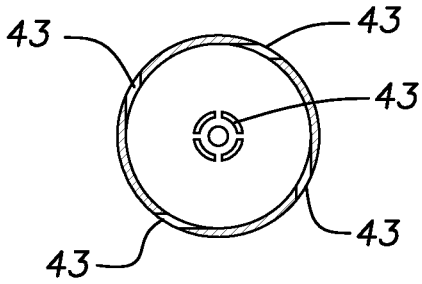
Figure 2C:
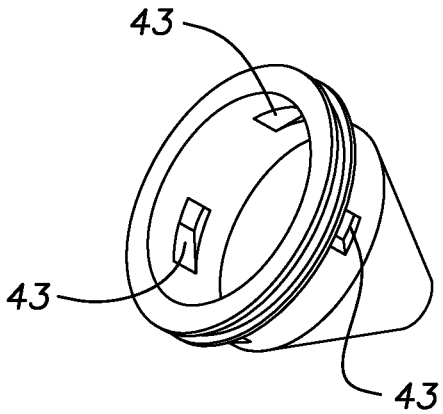
Figure 2D:
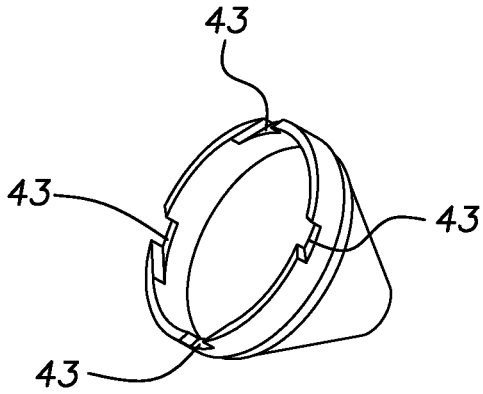

The tangential flow generator 4 is shown in FIGS. 2A to 2D, wherein FIG. 2(*a*) is a front view, FIG. 2B is a sectional view taken along section line 2B-2B of FIG. 2A, FIG. 2C is a side view of FIG. 2A, and FIG. 2D is a side view of FIG. 2B. The whole structure of the tangential flow generator is characterized by comprising a conical section 44, a cylindrical section 42 and a mounting groove 41 of the sealing ring 6 and being hollow inside. The lower end of the conical section 44 is provided with an annular hole 45. The wall of the cylindrical section 42 is evenly provided with a plurality of inflow openings 43, the cross section of the inflow openings 43 can be square, rectangle, circle or other shape. When each inflow opening 43 is square or rectangle, the surface farthest away from the central axis is tangent to the inner wall of the cylindrical section 42; and when each inflow opening is circle, ellipse or other shape, the generatrix of the inflow opening 43 farthest away from the central axis is tangent to the inner wall of the cylindrical section 42.

Figure 3:
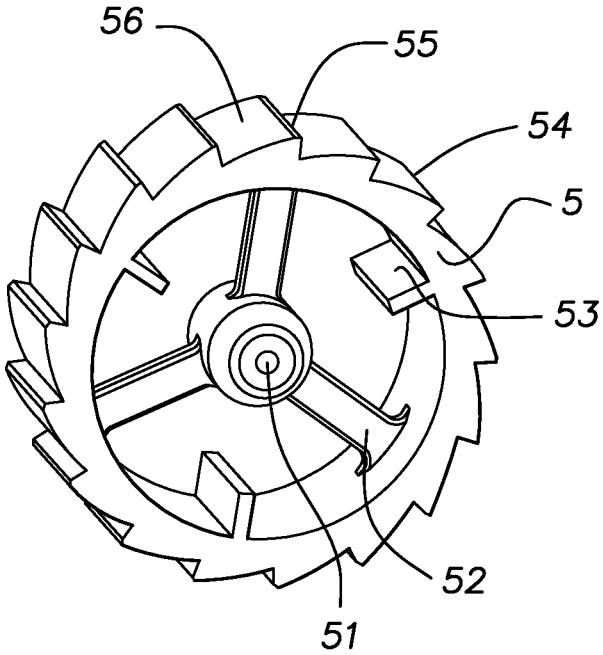
FIG. 3 is a structural diagram of the hydraulic rotator.

The hydraulic rotator 5 as shown in FIG. 3 is characterized in that the whole structure is a cylindrical ring comprising a central shaft hole 51, shaft hole support ribs 52, a plurality of evenly distributed damping plates 53 and a plurality of evenly distributed torsion teeth 54. Said damping plates 53 are flat plates, positioned on the inner wall of the cylindrical ring and points at the axle center. Said each torsion tooth 54 consists of a stress surface 55 and a water flow transition surface 56. Said stress surface 55 is a flat surface and points at the axle center, and can be a curved surface alternatively. Said transition surface 56 can be either curved surface or flat surface from the highest position of the stress surface to the lowest position of the next stress surface.

Figure 4:
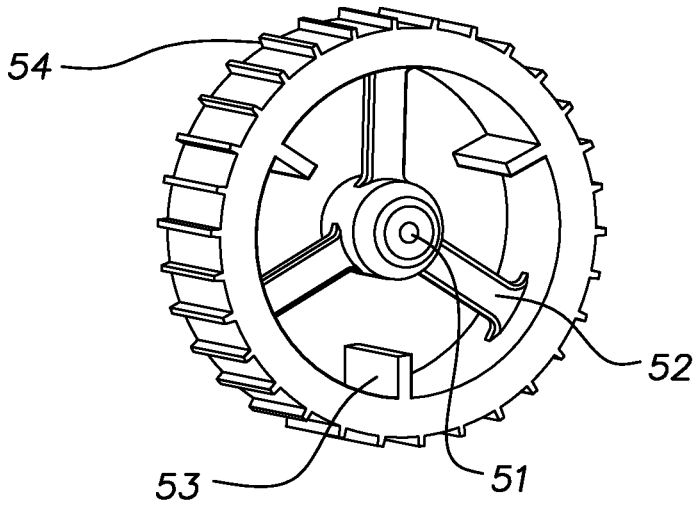
FIG. 4 is an additional structural diagram of the hydraulic rotator.

FIG. 4 shows another structure of the hydraulic rotator 5, the torsion teeth 54 thereof are a plurality of evenly distributed short flat plates, positioned on the outer wall of the cylindrical ring and point at the axle center.

Figure 5:
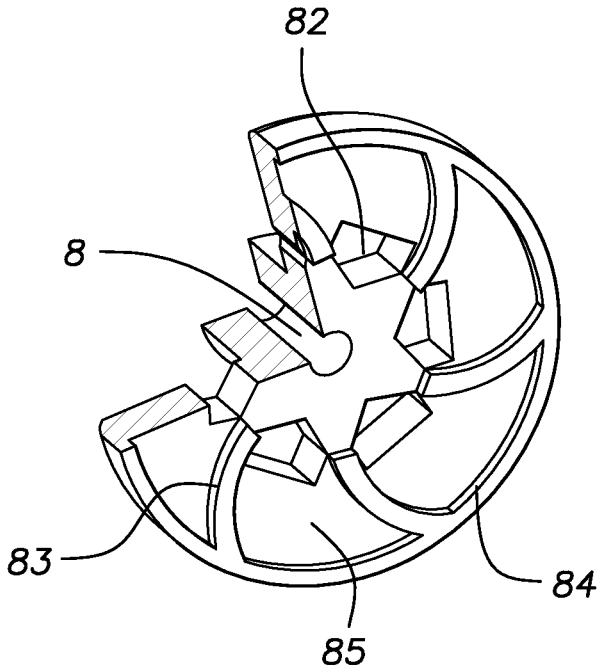
FIG. 5 is a structural diagram of the hydraulic driving disc.

The hydraulic driving disc 8 as shown in FIG. 5 has the whole structure of a disc comprising a shaft hole 81, a plurality of inflow holes 82, a plurality of swirling flow ribs 83, a baseplate 85 and an outer ring 84. Said baseplate 85 is perpendicular to the shaft hole 81. Said inflow holes 82 are positioned on the baseplate 85, close and parallel to the shaft hole 81 and completely penetrate through the baseplate 85. The outer ring 84 is posited on the baseplate 85 and at the outer edge of the baseplate 85. The swirling flow ribs 83 are positioned on the baseplate 85 and protrude a certain height, the cross section of the swirling flow ribs can be square, rectangle, semicircle and the like, the baseline of said each swirling flow rib 83 is a curve which is connected with the outer ring 84 on one end and ends at the edge of the inflow hole 82 on the other end and points the central line of the shaft hole 81, the curve can be a section of a circular arc, a section of an elliptic line, a section of an involute, or other curve; and the baseline of each swirling flow rib 83 can be a straight line.

Figure 6:
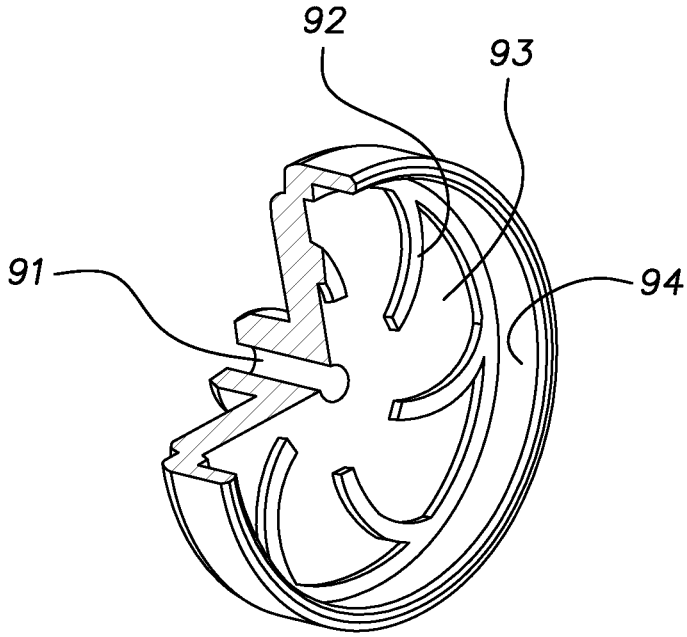
FIG. 6 is a structural diagram of the nozzle driving disc.

The nozzle driving disc 9 as shown in FIG. 6 has the whole structure of a disc comprising a shaft hole 91, a plurality of swirling flow ribs 92, a baseplate 93 and an outer ring 94. Said baseplate 93 is perpendicular to the shaft hole 91. The outer ring 94 is positioned on the baseplate 93 and at the edge of the baseplate 93. The swirling flow ribs 92 are positioned on the baseplate 93 and protrude a certain height, the cross section of the swirling flow ribs can be square, rectangle, semicircle and the like, the baseline of each swirling flow rib 92 is a curve which is connected with the outer ring 94 on one end, and the other end of the curve points at the central line of the shaft hole 81; the curve can be a section of a circular arc, a section of an elliptic line, a section of an involute, or other curve; and the baseline of each swirling flow rib 92 can be a straight line.

Figure 7:
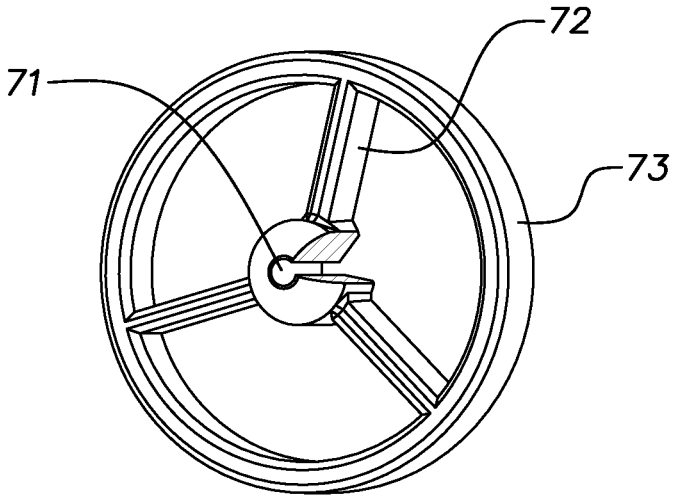
FIG. 7 is a structural diagram of the bracket.

The support bracket 7 as shown in FIG. 7 comprises a shaft hole 71, a plurality of evenly distributed brackets 72 and support rings 73.

The invention has the following working process:

Water is divided into two parts after passing through the filter 2, one part directly enters the tangential flow generator 4 from the annular hole 45 of the tangential flow generator 4, the other part flows through the external surface of the tangential flow generator 4 and then enters the tangential flow generator 4 from the tangential inflow openings 43 and rotates along the inner wall surface of the cylindrical section 42 of the tangential flow generator 4 to lash the torsion teeth 54 of the hydraulic rotator 5 whereby the hydraulic rotator 5 rotates. When water pressure is overhigh or has fluctuation, because water entering the tangential flow generator 4 from the annular hole 45 of the tangential flow generator 4 flows along the axis, Damping moment generated by the damping plates 53 of the hydraulic rotator 5 to the rotating of the hydraulic rotator 5 changes and thus ensures that the variation of the rotational angular velocity of the hydraulic rotator 5 is small.

The two parts of the water in the tangential flow generator 4 continue flow downstream, the hydraulic driving disc 8 is fixedly connected with the hydraulic rotator 5 via a shaft, and when the hydraulic rotator 5 rotates, the hydraulic driving disc 8 is driven to rotate. A part of water flows in the gap between the hydraulic driving disc 8 and the nozzle driving disc 9 from the inflow holes 82 on the hydraulic driving disc 8, the swirling flow ribs 83 on the hydraulic driving disc 8 causes rotation of the water, and the rotating water drives the swirling ribs 92 on the nozzle driving disc 9 such that the nozzle driving disc 9 is driven to rotate to drive the spraying head to rotate.

The invention claimed is:

1. A driving device for lifting buried spraying head comprising a case (2), a filter (3) provided in the lower end of the case (2), and a spraying head driving unit which is disposed inside the case (2), connected with a spraying head positioned on the top of the case (2) via a main shaft, and drives the spraying head to rotate and spray water, characterized in that the spraying head driving unit comprises a tangential flow generator (4) and a hydraulic rotator (5), wherein the tangential flow generator (4) is a small case structure which is hollow, a water supply gap is formed between the tangential flow generator and the inner wall of the case (2), inflow openings (44) are arranged on the shell wall of the tangential flow generator (4), the hydraulic rotator (5) is disposed inside the tangential flow generator (4), the hydraulic rotator (5) has stress surfaces (55) corresponding to the inflow openings (44), and the hydraulic rotator (5) connects with the spraying head directly or indirectly via the main shaft.

2. The driving device according to claim 1, characterized in that the shell wall of the tangential flow generator (4) is provided with a plurality of inflow openings (44) which are evenly distributed, the whole hydraulic rotator (5) is of a cyclic structure or disc structure, the outer edge of the hydraulic rotator is provided with a plurality of evenly distributed stress surfaces (55) corresponding to the inflow openings (44), a gap exits between each stress surface (55) and the corresponding inflow opening (44), water flows in the tangential flow generator (4) from the inflow openings (44) and lashes the stress surfaces (55) of the hydraulic rotator (5) to rotate the hydraulic rotator (5).

3. The driving device according to claim 1, characterized in that the tangential flow generator (4) comprises a conical section (44) and a cylindrical section (42), wherein the lower part of the conical section (44) is provided with an annular hole (45), and the wall of the cylindrical section (42) is provided with evenly distributed inflow openings (43).

4. The driving device according to claim 3, characterized in that the tangential flow generator (4) further comprises a sealing ring mounting groove (41) positioned on the upper end of the cylindrical section (42), and a sealing ring (6) for realizing sealing between the tangential flow generator (4) and the inner wall of the case (2) is mounted in the sealing ring mounting groove (41).

5. The driving device according to claim 2, characterized in that the hydraulic rotator (5) comprises a cylindrical ring body, a central shaft hole (51) positioned on the center of the cylindrical ring body, shaft hole support ribs (52) connected with the central shaft hole (51) and the inner wall of the cylindrical ring body, and torsion teeth (54) evenly distributed on the outer wall of the cylindrical ring body, wherein the torsion teeth have stress surfaces (55).

6. The driving device according to claim 5, characterized in that damping plates (53) are evenly distributed on the inner wall of the cylindrical ring body.

7. The driving device according to claim 1, characterized in that the spraying head driving unit further comprises a hydraulic driving disc (8) and a nozzle driving disc (9), wherein the hydraulic driving disc (8) is positioned above the hydraulic rotator (5) and coaxially connected with the hydraulic rotator (5); the nozzle driving disc (9) is mounted above the hydraulic driving disc (8), a gap is formed between the nozzle driving disc and the hydraulic driving disc (8) in the axial direction, and the nozzle driving disc (9) is connected with the spraying head via a main shaft.

8. The driving device according to claim 7, characterized in that the hydraulic driving disc (8) is provided with inflow holes (82) and first swirling flow ribs (83), water below the hydraulic driving disc (8) enters the gap between the hydraulic driving disc (8) and the nozzle driving disc (9) from the inflow holes (82) and rotates under the action of blocking of the first swirling flow ribs (83).

9. The driving device according to claim 7, characterized in that the surface of the nozzle driving disc (9) opposite to the hydraulic driving disc (8) is provided with second swirling flow ribs (92), and the nozzle driving disc (9) rotates under the action of water current impacting the second swirling flow ribs (92) and thus to drive the spraying head to rotate and spray water.

10. The driving device according to claim 7, characterized in that the main shaft used for connecting the hydraulic driving disc (8) and the hydraulic rotator (5) is mounted on a bracket (7), the main shaft used for connecting the nozzle driving disc (9) and the spraying head is mounted on the bracket (7) as well, and the bracket (7) is fixed on the inner wall of the case (2).

* * * * *